US005588223A

United States Patent [19]

Marshall

[11] Patent Number: 5,588,223

[45] Date of Patent: Dec. 31, 1996

[54] RESTRAINED PAPER DRYER

[75] Inventor: Hugh G. Marshall, Hudson, Canada

[73] Assignee: Asea Brown Boveri Inc., Quebec, Canada

[21] Appl. No.: 259,503

[22] Filed: Jun. 14, 1994

[51] Int. Cl.[6] ..... F26B 5/04

[52] U.S. Cl. ..... 34/414; 34/444; 34/481; 34/487; 34/111; 34/112; 34/123; 34/135; 34/635; 34/636

[58] Field of Search ..... 34/306, 361, 362, 34/363, 414, 430, 444, 481, 487, 111, 112, 122, 123, 135, 629, 635, 636

[56] References Cited

U.S. PATENT DOCUMENTS

| | | | |
|---|---|---|---|
| 1,104,759 | 7/1914 | Sheahan | 34/117 |
| 1,707,015 | 3/1929 | Jones | 34/112 |
| 2,010,917 | 8/1935 | Du Pont | 34/12 |
| 2,590,849 | 4/1952 | Dungler | 34/37 |
| 3,237,316 | 3/1966 | Sachs | 34/115 |
| 3,378,936 | 4/1968 | Buss | 34/116 |
| 3,447,247 | 6/1969 | Daane | 34/122 |
| 3,473,236 | 10/1969 | Fleissner | 34/115 |
| 3,503,136 | 3/1970 | Fleissner | 34/15 |
| 3,541,697 | 11/1970 | Villalobos | 34/115 |
| 3,570,137 | 3/1971 | Fleissner | 34/115 |
| 3,609,872 | 10/1971 | Fleissner | 34/23 |
| 3,913,241 | 10/1975 | Chaikin et al. | 34/122 |
| 4,036,684 | 7/1977 | Schmitt et al. | 162/290 |
| 4,074,441 | 2/1978 | Helversen et al. | 34/122 |
| 4,096,643 | 6/1978 | Futcher | 34/122 |
| 4,140,574 | 2/1979 | Justus | 162/257 |
| 4,186,496 | 2/1980 | Beke et al. | 34/114 |
| 4,628,618 | 12/1986 | Virta et al. | 34/116 |
| 4,680,873 | 7/1987 | Fellers et al. | 34/116 |
| 4,686,777 | 8/1987 | Cooke | 34/116 |
| 4,716,660 | 1/1988 | Thiele | 34/114 |
| 5,127,168 | 7/1992 | Pikulik | 34/18 |
| 5,149,401 | 9/1992 | Langevin et al. | 34/444 X |
| 5,279,049 | 1/1994 | Skaugen et al. | 34/115 |

FOREIGN PATENT DOCUMENTS

| | | |
|---|---|---|
| 894316 | 2/1972 | Canada . |
| 1019947 | 1/1977 | Canada . |
| 1126013 | 6/1982 | Canada . |
| 2001370 | 7/1978 | United Kingdom . |
| 1600518 | 10/1981 | United Kingdom . |
| 9113205 | 9/1991 | WIPO . |
| 9323616 | 11/1993 | WIPO . |

OTHER PUBLICATIONS

*The Paper Dryer Process Part II—Mill Trials*—B. W. Burgess, W. Seto, E. Koller and I. T. Pye "Pulp and Paper Magazine of Canada" pp. 73–81 Nov. 1972.

A new method for restrained drying of paper in cross direction—Karlsson pp. 286–293.

The Effect of Superheated Steam Drying on the Properties of TMP Paper N. A. Poirer et al—Journal of Pulp & Paper Science pp. J97–J102 Apr. 4, 1994.

Drying Strategies and a New Restraint Technique to Improve Cross-Directional Properties of Paper—Hansson et al—Fundamentals of Papermaking Sep. 1989 pp. 743–781.

On the Suction Drying of paper—W. D. Baines and J. F. Keffer Pulp and Paper Magazine of Canada 1968.

*Primary Examiner*—Henry A. Bennett
*Assistant Examiner*—Steve Gravini
*Attorney, Agent, or Firm*—David L. Davis

[57] ABSTRACT

Methods and apparatus are disclosed for restrained paper drying in order to produce high performance paper with enhanced stiffness and, in the process, substantially improve paper properties and reduce fiber usage. The paper web is held in a restrained position on a fabric by air suction imposed from beneath the web and is of sufficient application to prevent shrinkage of the web. The web is simultaneously dried by high velocity, high temperature air or superheated steam. For improved finish properties, the wet paper web may be pressed onto a polished heated metal cylinder with restraint being imposed by gluing.

14 Claims, 21 Drawing Sheets

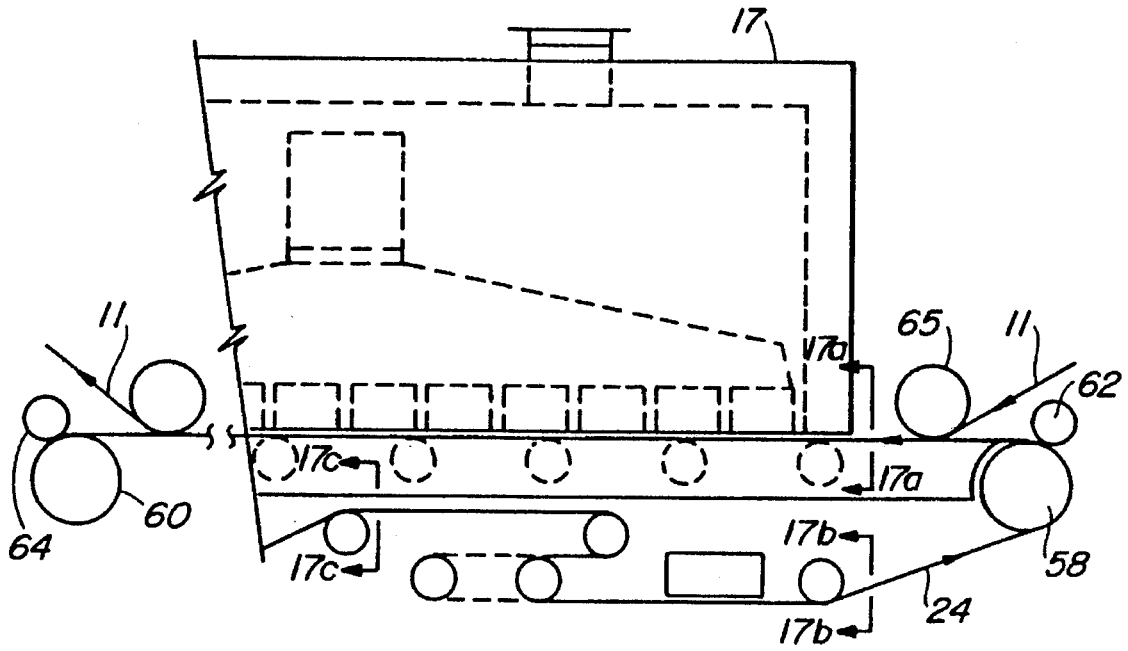
FIG. 16
FIG. 17a
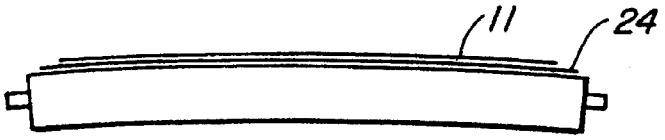
FIG. 17b
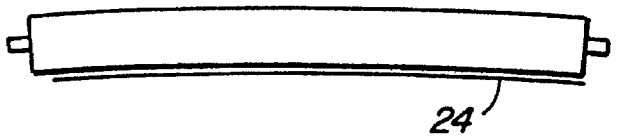
FIG. 17c
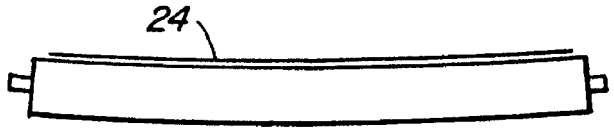

RESTRAINED PAPER DRYER

FIELD OF THE INVENTION

This invention relates to the drying of web material and specifically to restrained drying of paper web material for the manufacture of all grades of paper and high performance container board.

BACKGROUND OF THE INVENTION

There are always requirements for improvements in the art of drying paper web materials of all grades. As an example, the manufacture of container board is open to changes and improvements due to amendments to the United States shipping industry Rule 41. For over seventy years the container industry specifications for boxes have been governed by the parameters of maximum weight of the contents relative to given container dimensions, combined with bursting strength, puncture strength and basic weight of linerboard and corrugated medium. In view of the amended Rule 41, the relationship between the maximum weight of the contents versus the outside dimension of the container is maintained but "edge crush strength" takes the place of other requirements.

The current procedures of stacking containerized goods can sometimes lead to the collapse of the lowermost containers with resulting damage to the contents therein. In order to determine acceptable stacking limitations, an edge crush test for the combined container board and a ring crush test for linerboard and the corrugated medium have been introduced.

Conventional methods of producing container board are inefficient when it comes to providing a product to meet the new requirements. Current manufacturing methods use too much fibre to manufacture a high performance container board that has the edge and strength requirements as specified in Rule 41.

One example of prior practice is shown in U.S. Pat. No. 3,447,247 Daane of Jun. 3rd, 1969. In this patent, the process utilizes impingement air jets to penetrate the paper web and push the water out of the web. Reference is made in the patent towards the production of tissue paper, specific mention being made of a wet permeable web. The Daane process uses air jets and the air therefrom is caused to pass through the web by momentum. There is some suction but it is very localized opposite the impingement jet nozzles.

A further example of prior art is disclosed in British Patent 1,600,518 published Oct. 14, 1981. This specification discloses a web drying apparatus utilizing a suction box for applying vacuum to the underside of the web and Using air caps over the web for applying drying air to the upper surface thereof. However, mention is made of only 1 to 2 inches of $H_2O$ and possibly up to 4 inches for the use of threading. However, there is no reference in the specification for the use of suction to restrain a paper web nor is there any disclosure of using such suction in the ranges specified in the present invention.

Another example of the known art is seen in U.S. Pat. No. 4,680,873 of Jul. 21, 1987 to Fellers et al. This patent discloses a method and apparatus to control or regulate the shrinkage and/or the stretching of a paper web transverse to it's travelling direction. At a point in the process where the paper web has a certain dry solids content, the paper is subjected to an outwardly directed force that acts in the edge portion of the web. The means applying the outwardly directed force direct streams of pressurized air against the edge portions to create frictional forces against the paper. The means may also utilize a combination of air streams and mechanical devices such as strip-like members located on each side of the web and to accompany the web over drying cylinders, the members being fixed to the cylinders by grooves therein. An example is found in "A New Method for Restrained Drying of Paper in the Cross Direction", I. Karlsson Eucepa 1990, page 286.

A further example of known art is U.S. Pat. No. 5,279,049 Jan. 18, 1994 Skaugin et al. This patent discloses a method and apparatus for the restrained drying of a paper web in the dryer section of a paper machine. In this patent, the method and apparatus described therein replaces heating means, namely steam cylinders with high temperature, high velocity air or superheated steam.

None of the references of the prior art referred to above discloses methods and apparatus for completely restraining a paper web in accordance with the method and apparatus of the present invention.

Further examples of the prior art are as follows:

U.K. Patent Application GB 2,001,370 A published Jan. 31, 1979;

U.S. Pat. No. 4,036,684 issued Jul. 19, 1977; and

PCT International Application WO93/23616 published Nov. 25, 1993.

SUMMARY OF THE INVENTION

The present invention is directed to improvements in the drying of web materials such as paper used in the production of container board, as well as other paper grades and which will provide a substantial reduction in fibre usage or improvement in paper property. The inventive concept is to restrain a paper web, for example linerboard web, from shrinking by holding it on a fabric with a suction imposed on the fabric through a suction box. The paper/linerboard web, while being restrained, is dried through the use of high velocity, high temperature air or superheated steam. As an example, 25,000 fpm, 600° F. to 800° F. air, or 700° F. superheated steam would be used.

Apparatus for carrying out this process would replace all or a portion of the steam cylinders presently used to dry paper.

According to the invention, a moving paper web is dried with high velocity, high temperature air or superheated steam and this is accomplished while the paper is held in a restrained mode on an open weave fabric with a suction imposed from underneath the web. The result of the process according to the invention is paper that requires approximately 15% to 30% less fibre to give the same ring crush property as normally dried paper. In the apparatus according to the invention, high impingement drying is used while at the same time the web is held in a restrained mode to prevent any shrinkage. It is the prevention of the shrinkage during drying that gives the paper web its 15% extra ring crush properties.

An additional 15% reduction in fibre to give the same ring crush can be obtained by using superheated steam instead of high temperature air. See Poirier, N. A. "The Effect of Superheated Steam Drying on the Properties of Paper", Phd Thesis, McGill University, Montreal 1992.

Additionally, shrinkage of the web of 6 to 8% would be prevented and this would allow the headbox slice to be set uniformly. The uniform slice setting would prevent twist warp, curl, cockle and grainy edges. This results in an extra 6 to 8% in square footage in container board.

If two-sided drying is required, two suction boxes in series would be utilized, the second box having the air flow against the web opposite to that in the first suction box.

The amount of suction required to prevent shrinkage will vary from the wet end to the dry end of the apparatus. At 40% bone dry almost no suction is required as there is very little shrinkage force to be opposed. The substantial shrinkage force starts about 55% bone dry and will get stronger as the web dries. Therefore, the suction along the length of the restrained dryer will vary from say 3 inches $H_2O$ to twelve inches $H_2O$.

Baffling could be provided in the suction chamber so that the suction can be varied from low at the wet end and high at the dry end.

Another purpose of the suction system is to provide sufficient restraint so that the high velocity air jets will not cause wrinkling of the web.

In a preferred embodiment, the web would enter the restrained dryer at 55% bone dry and be removed from the fabric by a suction roll at 75% bone dry and then would be pressed by a suction roll plastered onto a polished Yankee cylinder either without or with glue (keep restrained) to achieve a smooth finish. The Yankee type cylinder could be located at any moisture level, i.e., before, in the middle of, or after the restrained dryer.

In one arrangement of a restrained dryer according to the invention, the restrained paper dryer would dry a linerboard web under restraint from 55% bd to 93% bd using high velocity, high temperature or superheated steam with 25,000 fpm, 600° F. to 800° F. air, or 700° F. superheated steam.

According to this arrangement, the linerboard web would be restrained from shrinking by holding it on a fabric with a suction imposed on the underside of the fabric through a suction box. The fabric web would be supported by rolls that are placed inside the suction box.

Air bearings to support and cool the fabric would be used on the deckled edges of the fabric outside of the paper web, in the width dimension, would also have its edges cooled using air jets. The cooling nozzles would serve two purposes, one to prevent the spill of hot air out of the dryer enclosure and, secondly, to cool the fabric where there is no paper web.

Fabric blades with water to support the fabric and the web could be used in place of support rolls. Also, a grid of air bearings with hollow air bearing supply and support stands mounted from the bottom of the suction box could also be used to replace the support rolls.

Superheated steam drying of paper produces benefits both of stiffness and of strength. The use of superheated steam instead of high temperature air for drying with the restrained dryer of this invention would utilize an oil vaporizer coil which would be used as the circulation steam heating medium. The oil vaporizer coil would be fed from an oil vaporizer and would provide the necessary superheated steam that would be impinged at high velocity on the web. With restrained air drying of the web, according to the invention, the desired ring crush strength can be obtained with 15% less fibre and in the case of superheated steam a further 15% less fibre would be required, thus a paper mill with a dryer according to the invention would produce between 15 and 30% additional square footage of container board with the same amount of fibre from the pulp mill.

With the restrained dryer of the invention, additional paper property benefits can be obtained with fine paper because of the elimination of cockle, curl and grainy edges.

Depending on the moisture in the paper web when it is pressed by the suction roll against the Yankee type cylinder, there may be a need for glue to maintain the restraint. An alternative arrangement would be to glue the edges of the web to the Yankee cylinder in a similar manner to the cross strain process. Reference is made to "Fundamentals of Papermaking" Transactions of the Ninth Fundamental Research Symposium Held at Cambridge: September 1989.

Use of the Yankee type cylinder would provide a machine glazed finish on the top side of a linerboard web and would substantially eliminate the necessity of calendering. While it might not be possible to completely eliminate calendering it would be possible to have but a single soft nip calendar instead of the more usual calender stack, gloss calender and intercalendar dryers, an arrangement of substantial costs.

According to one feature of the restrained paper dryer of the present invention, the supply crescent headers to the nozzle pipes would be divided into multiple sections across the width of the web, so that the moisture could be controlled uniformly at the reel.

Another embodiment of the invention is to stretch the paper web to achieve additional stiffness and therefore to further diminish the quality of fibre required to give the same ring crush properties. The support rolls would be replaced with bowed rolls or bowed fabric blades with water. By holding back the fabric at the wet end of the restrained dryer it would be stretched ½ to 5% by running the nip at the dry end ½ to 5% faster. The bowed rolls or bowed fabric blades with water would cause the fabric to stretch ½ to 5% in the width dimension. Sufficient suction would be imposed to hold the fabric against the bowed rolls or bowed fabric blades with water so that the stretching would occur. The return run rolls or fabric blades with water would have a reverse bow i.e. would present a concave surface to the fabric. This would tend to remove the ½ to 5% width stretch which had been introduced into the fabric. To aid in the fabric width shrinkage and also to shrink the fabric back to its original length, water would be sprayed on the fabric in the return run and then dried to bring it back to its original length and width. Up to 4% additional web stiffness and square footage would be added using this stretching method.

According to one broad aspect, the invention relates to an improved method of drying and moving paper web comprising the steps of:

(a) holding the paper web in a restrained position in an open weave fabric by means of air suction of approximately 3 to 12 inches $H_2O$ imposed progressively from underneath the web and sufficient to prevent shrinkage of the web; and (b) applying a drying medium to the web in the form of high temperature, high velocity air or superheated steam whereby shrinkage of the web is substantially inhibited, ring crush strength is increased and fibre requirements are reduced.

According to a further aspect, the invention relates to apparatus for drying a moving paper web comprising an elongated module having a plurality of drying nozzles spaced through the length of the module; a suction box arranged opposite said module and the drying nozzles therein and defining a path of travel for the paper web between the nozzles and the suction box; means in the suction box for providing support for a fabric, web-supporting belt; means for delivering high velocity, high temperature drying medium to the nozzles for impingement against one surface of the web and means for simultaneously applying progressive suction from 3 to 12 inches $H_2O$ to the other surface of the web sufficient to prevent shrinkage thereof during drying.

BRIEF DESCRIPTION OF THE DRAWINGS

The invention is illustrated by way example in the accompanying drawings in which:

FIG. 16 is a conceptual, schematic drawing of a fabric stretch arrangement for the restrained dryer according to the invention;

FIGS. 17*a*, 17*b* and 17*c* are end views taken along the lines a, b and c respectively of FIG. 16;

DETAILED DESCRIPTION OF PREFERRED EMBODIMENTS

Figure 1A:
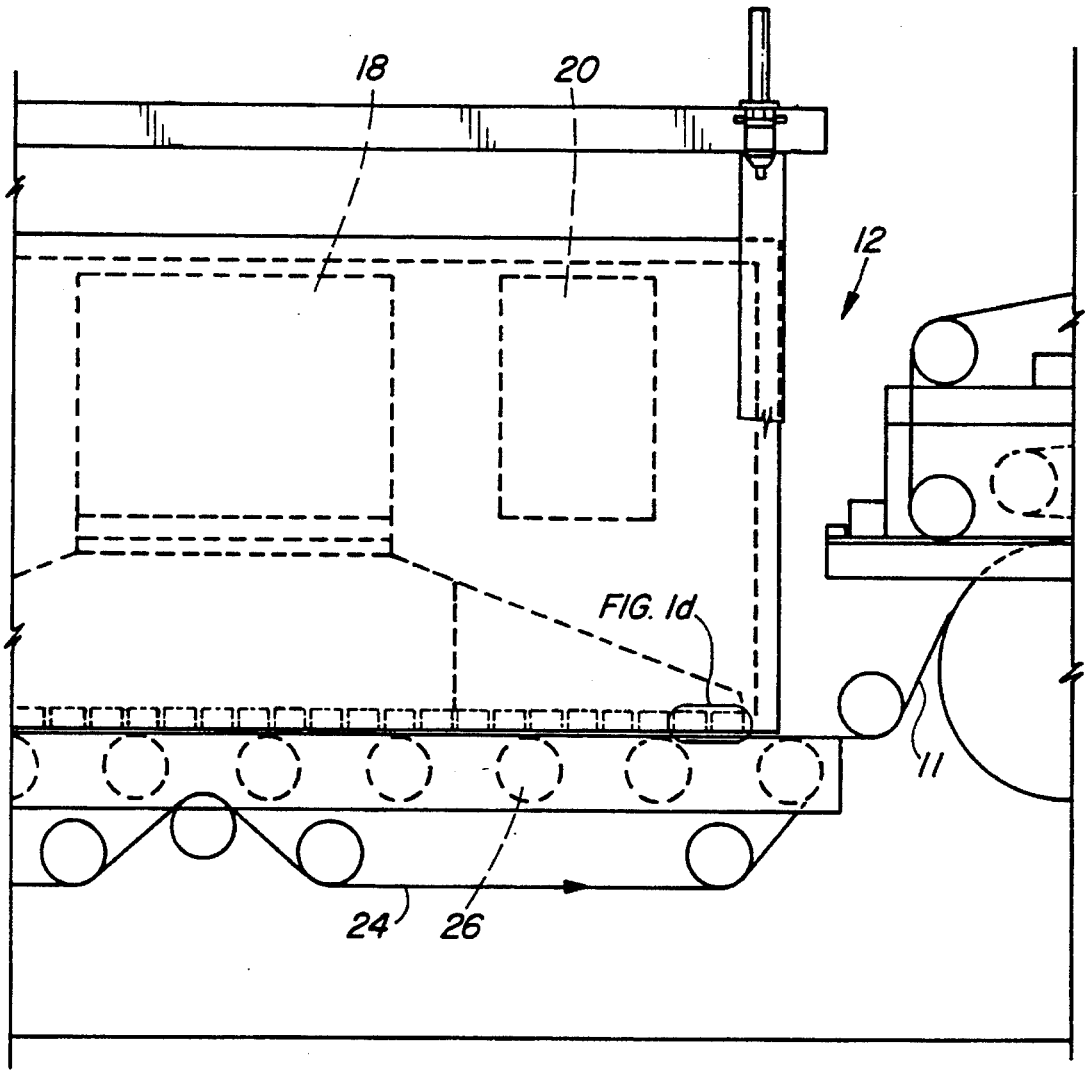
FIGS. 1*a*, 1*b* and 1*c*, together, are a side elevation of a restrained paper dryer module according to the invention.
Figure 1B:
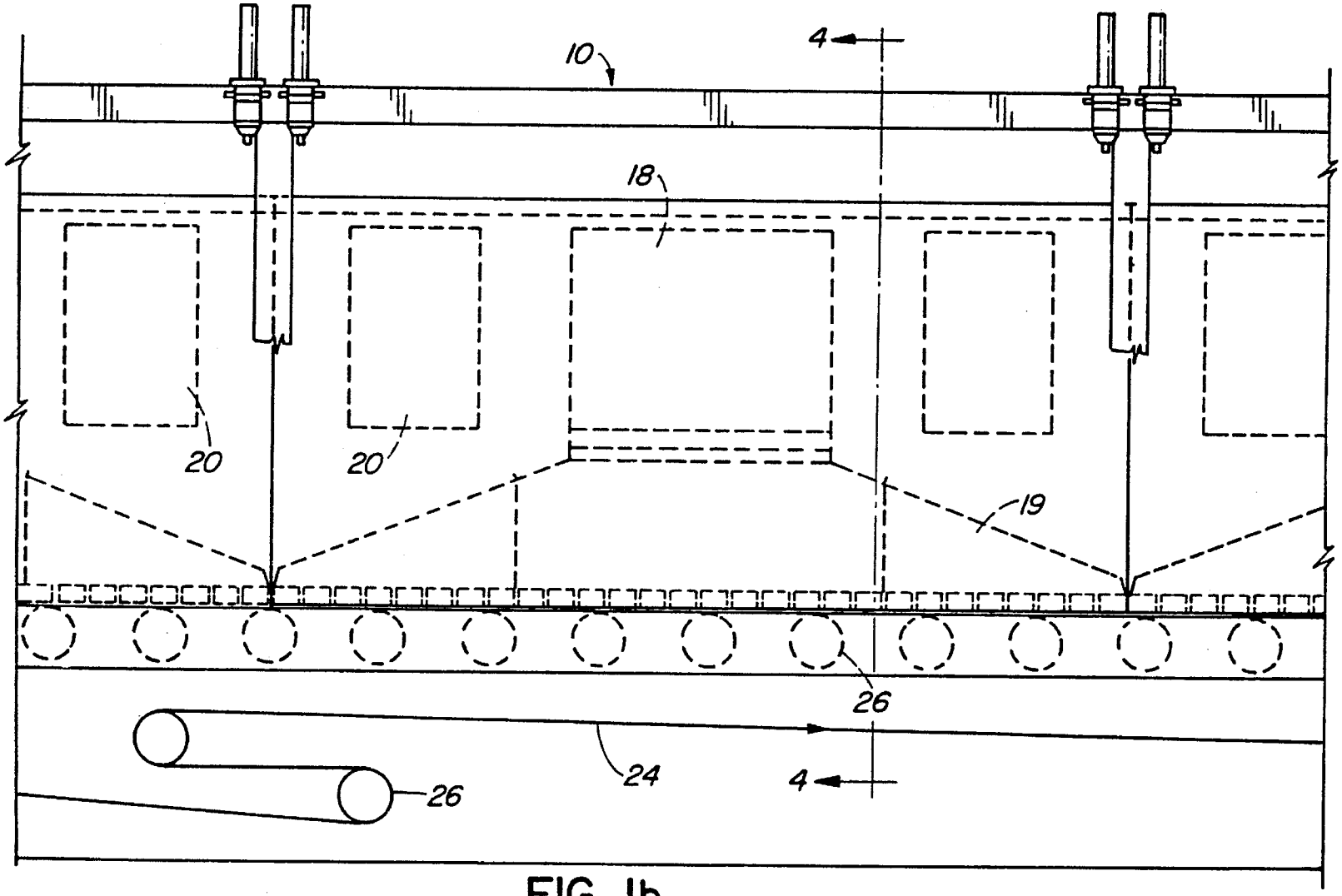
Figure 1C:
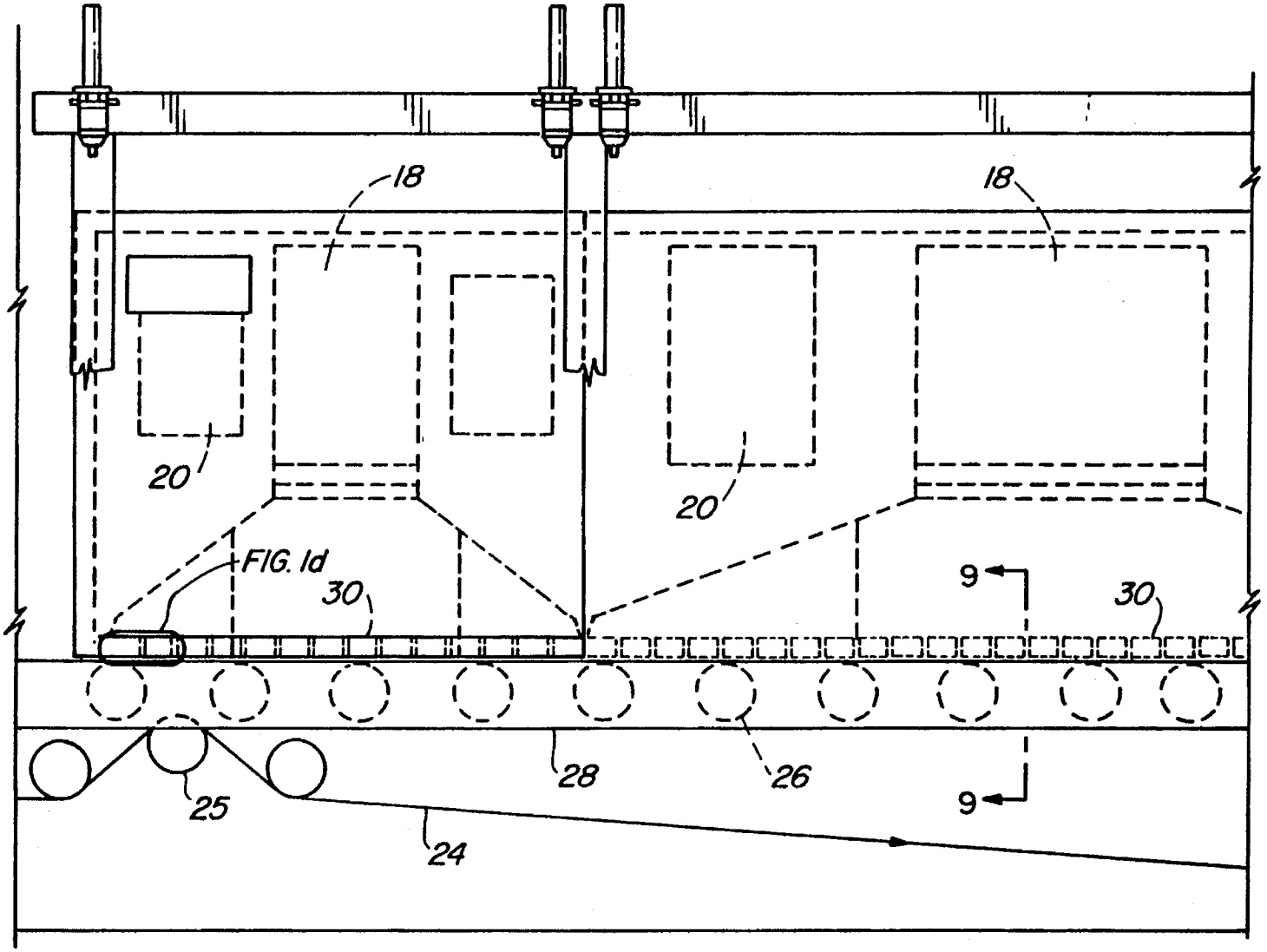

Referring to FIGS. 1*a* through 1*c* inclusive, a restrained dryer 12 comprises modules 10 integrated with a conventional paper dryer and takes a paper web 11 from the conventional dryer into the restrained dryer module 10, the web being approximately 55% dry at this point. Depending on associated apparatus at the dry end of the module (FIG. 1*c*, FIG. 2) the restrained dryer modules are adapted to dry container board under fabric suction restraint from 55% bd to 75% moisture, prior to a Yankee, and/to 93% bd at the reel under glue restraint.

Figure 4:
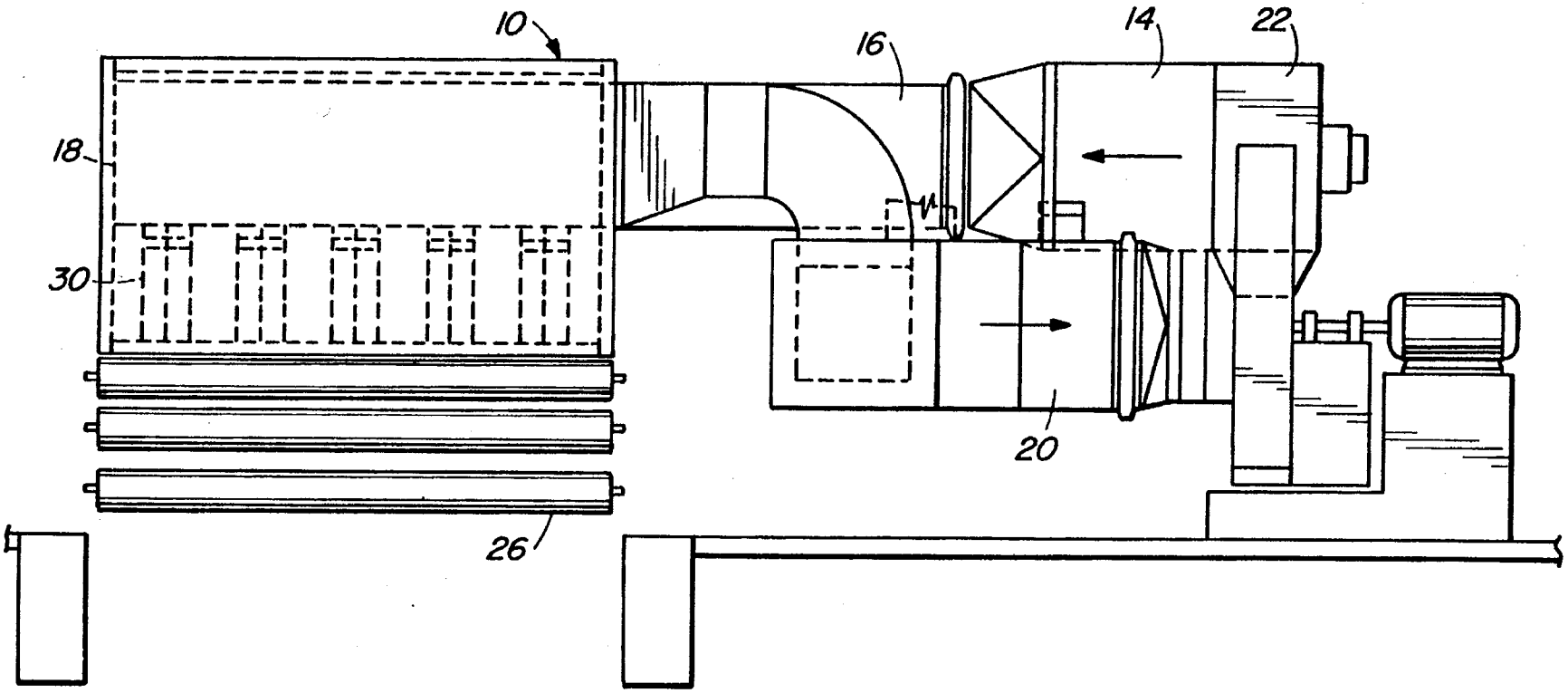
FIG. 4 is a cross-sectional view taken along the lines 4—4 of FIG. 1*b;*

By way of an arrangement of fans, duct work or burner chamber shown as an example in FIGS. 4 and 5 through 9, high temperature, high velocity air or superheated steam is transmitted to the dryer module 10. A direct-fired shell heater 14 is illustrated in FIG. 4 although a high temperature oil vaporizer coil or electric heater (not shown) could be substituted for the shell heater when superheated steam is desired. In either event, duct work 16 carries the drying medium to the supply plenums 18 and crescent headers 19 for delivery against the web, the medium being eventually recirculated through return duct work 20 to the supply fan 22.

According to the invention, the web is restrained from shrinking by holding it onto a fabric by means of suction imposed on the fabric within the confines of a suction box. Accordingly, as shown in FIGS. 1*a*–1*c*, the paper web 11 travels into the path defined by the restrained dryer nozzles 30 and the fabric 24 that is carried on carrier rolls 26 (and stretcher rolls where required), the carrier rolls being positioned in the suction box 28. Preferably, approximately 3 to 12 inches of water gauge suction is required to hold the web 11 against shrinkage although this would be somewhat dependent on the friction between the web 11 and the fabric 24 and, accordingly, a higher or lower suction could be provided to completely prevent shrinking. Less suction is needed at 60% moisture; more as the web gets drier and higher suction could be utilized at the wet end if sheet flutter is a problem.

Figure 5:
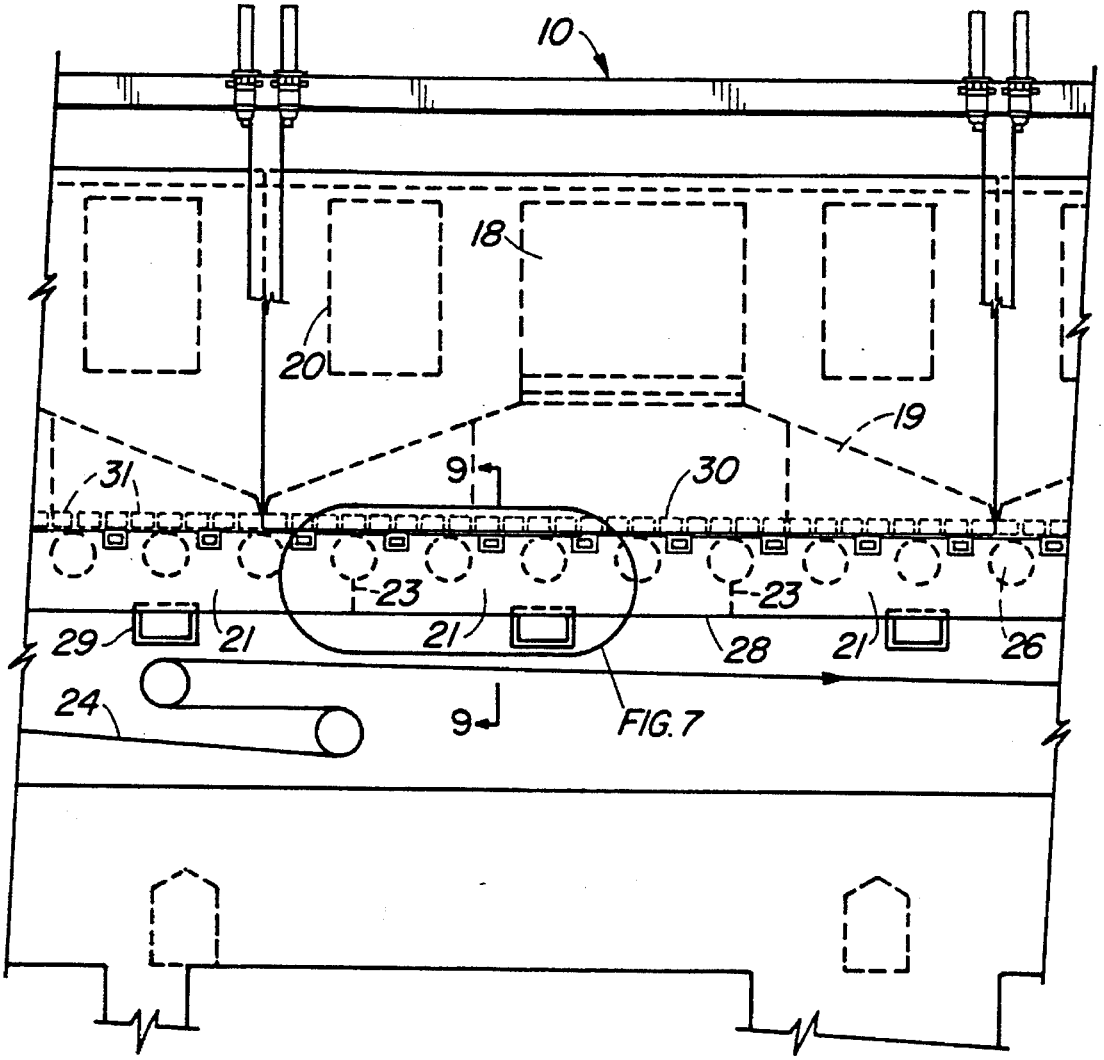
FIG. 5 is a more detailed elevation view of a section of the module.
Figure 6:
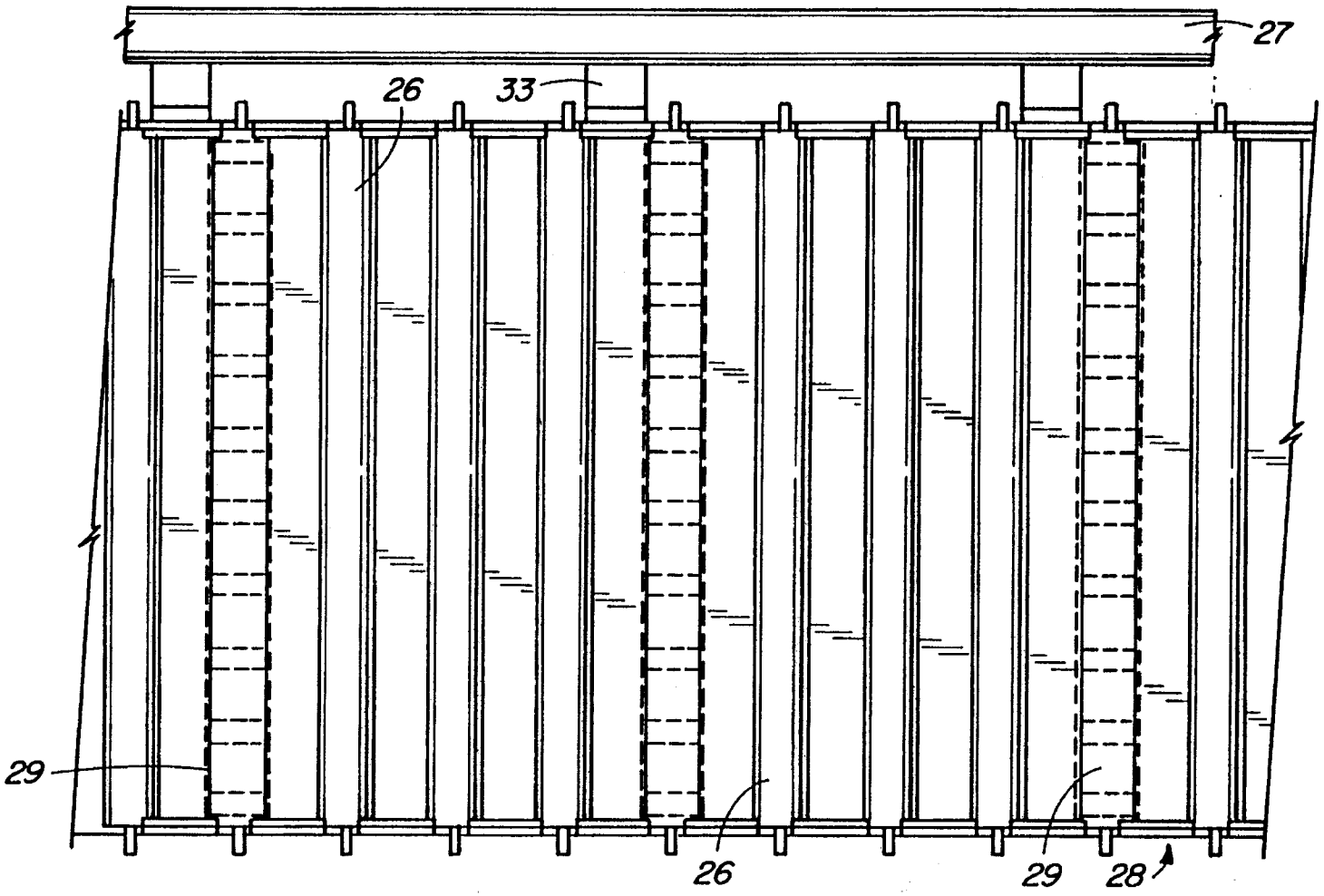
FIG. 6 is a plan view of FIG. 5.

As illustrated in FIGS. 1*a*–1*c* and in FIGS. 4 through 9, the supply headers 18 carry the drying medium to a plurality of nozzle pipes 30 which are divided into a plurality of sections 31 across the width of the module as shown in FIGS. 5 and 6. Such a division might not be necessary on all of the modules in the dryer but profile controls would be incorporated to provide operational control of the cross-machine moisture uniformly at the reel.

Figure 7:
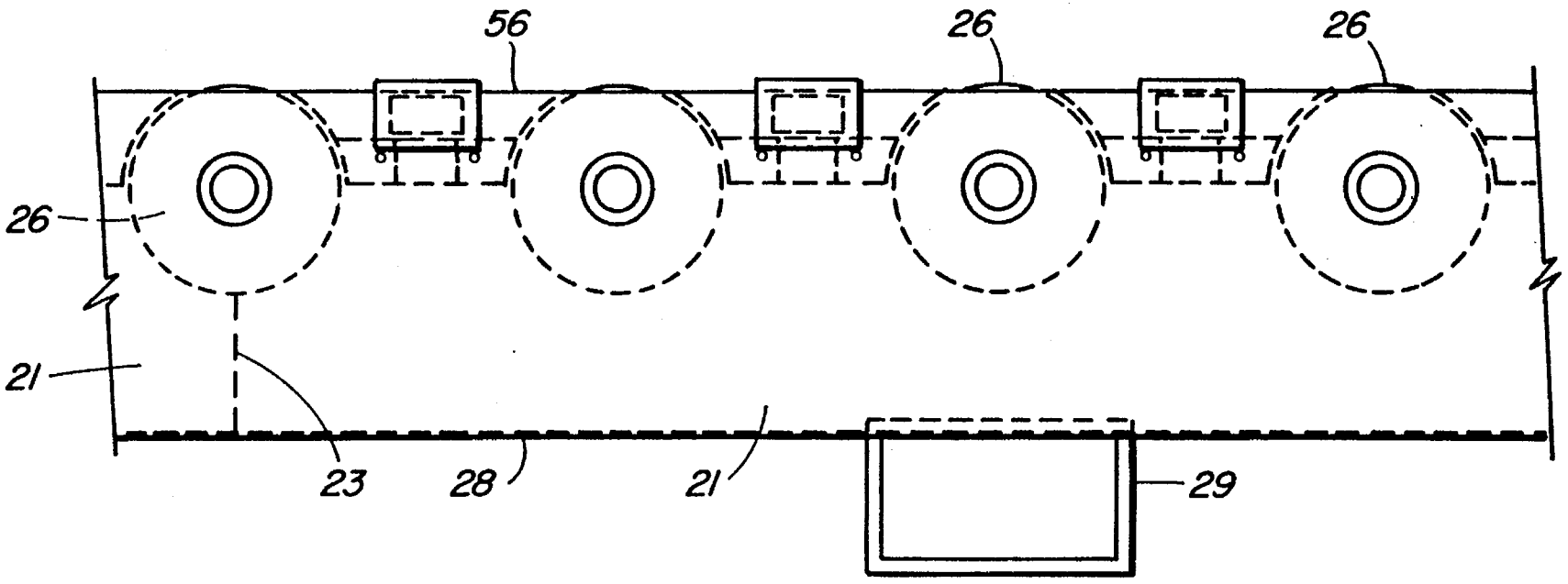
FIG. 7 is a detailed elevation view of a section of FIG. 5.
Figure 8:
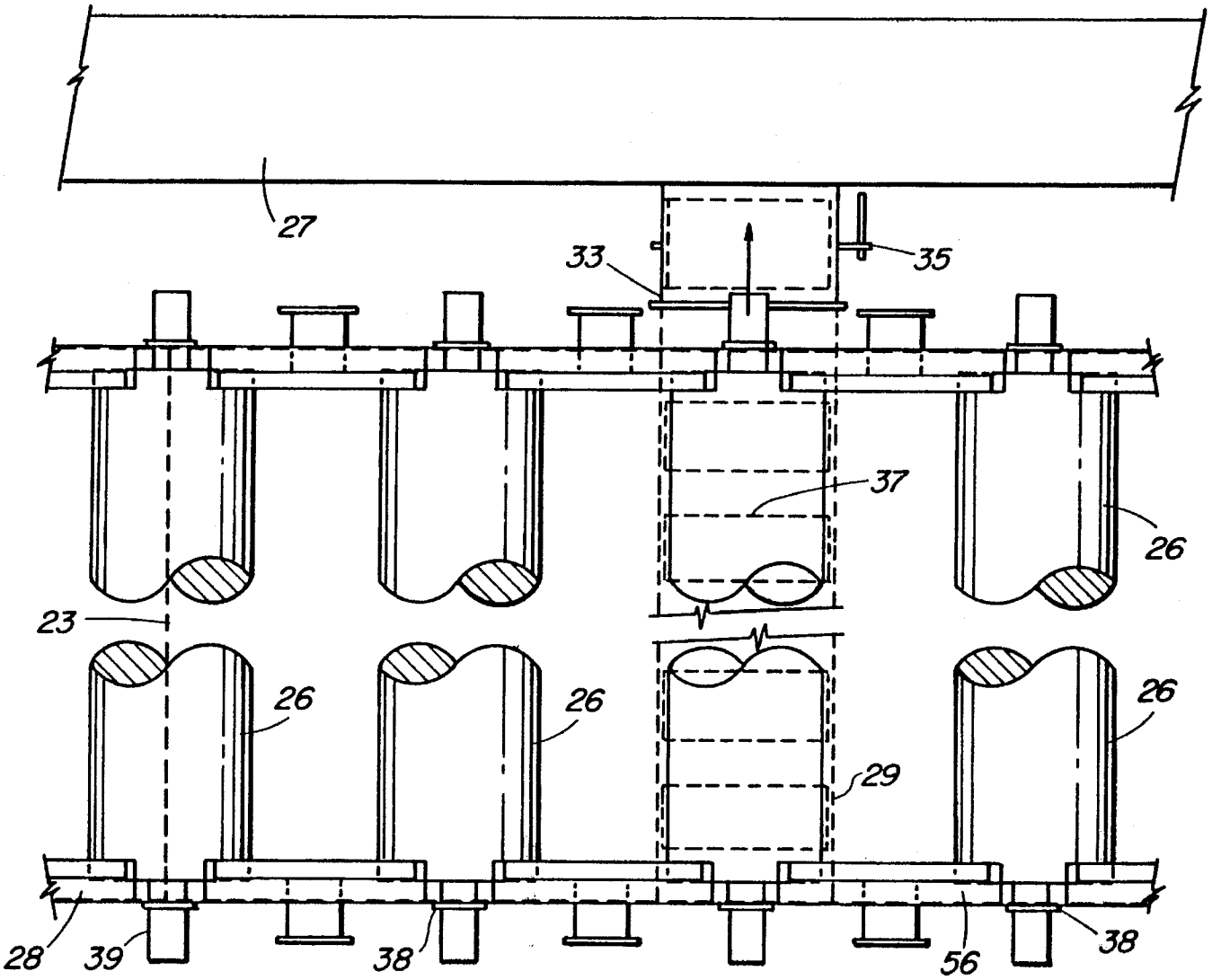
FIG. 8 is a plan view of FIG. 7.
Figure 9:
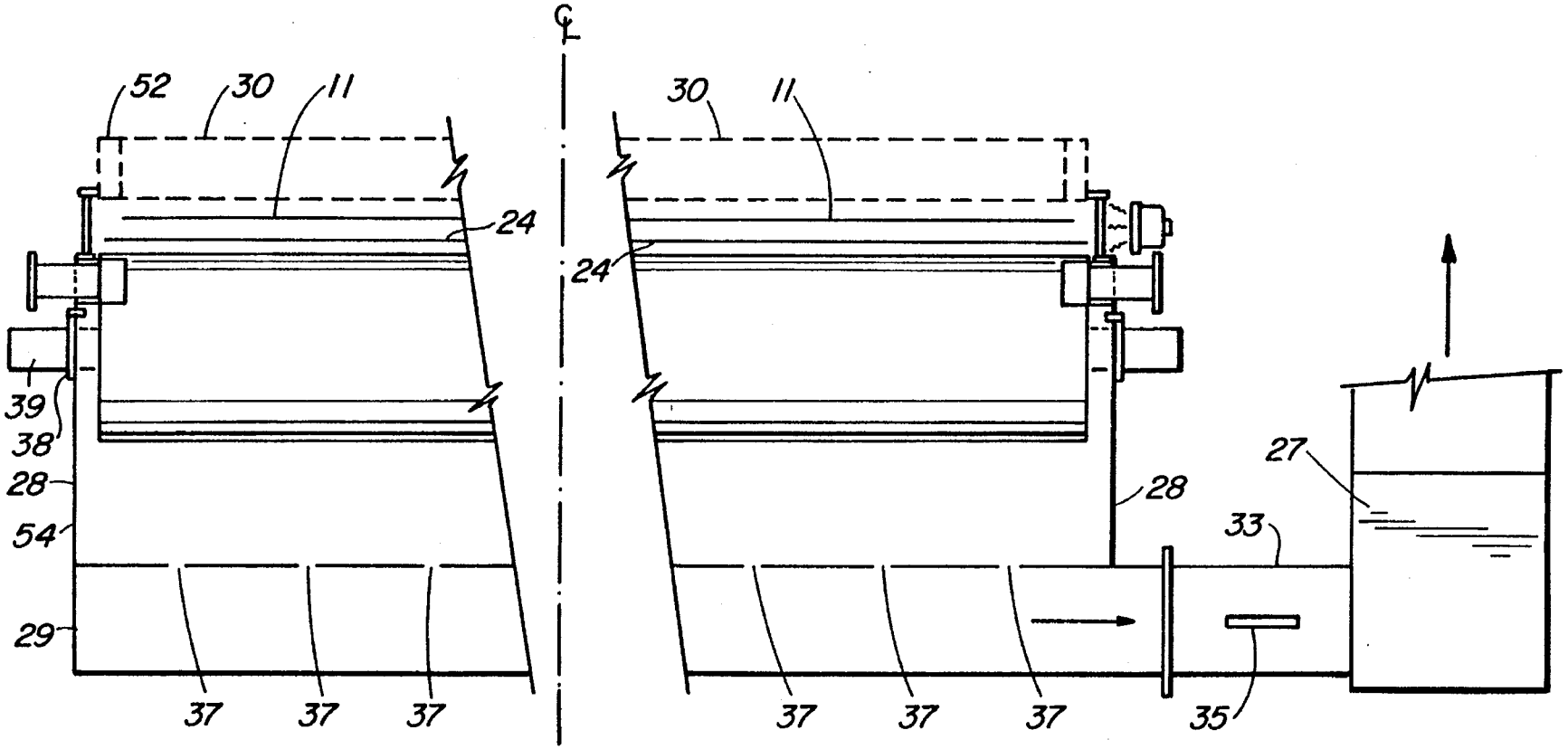
FIG. 9 is a sectional view taken along the lines 9—9 of FIG. 5.
Figure 10:
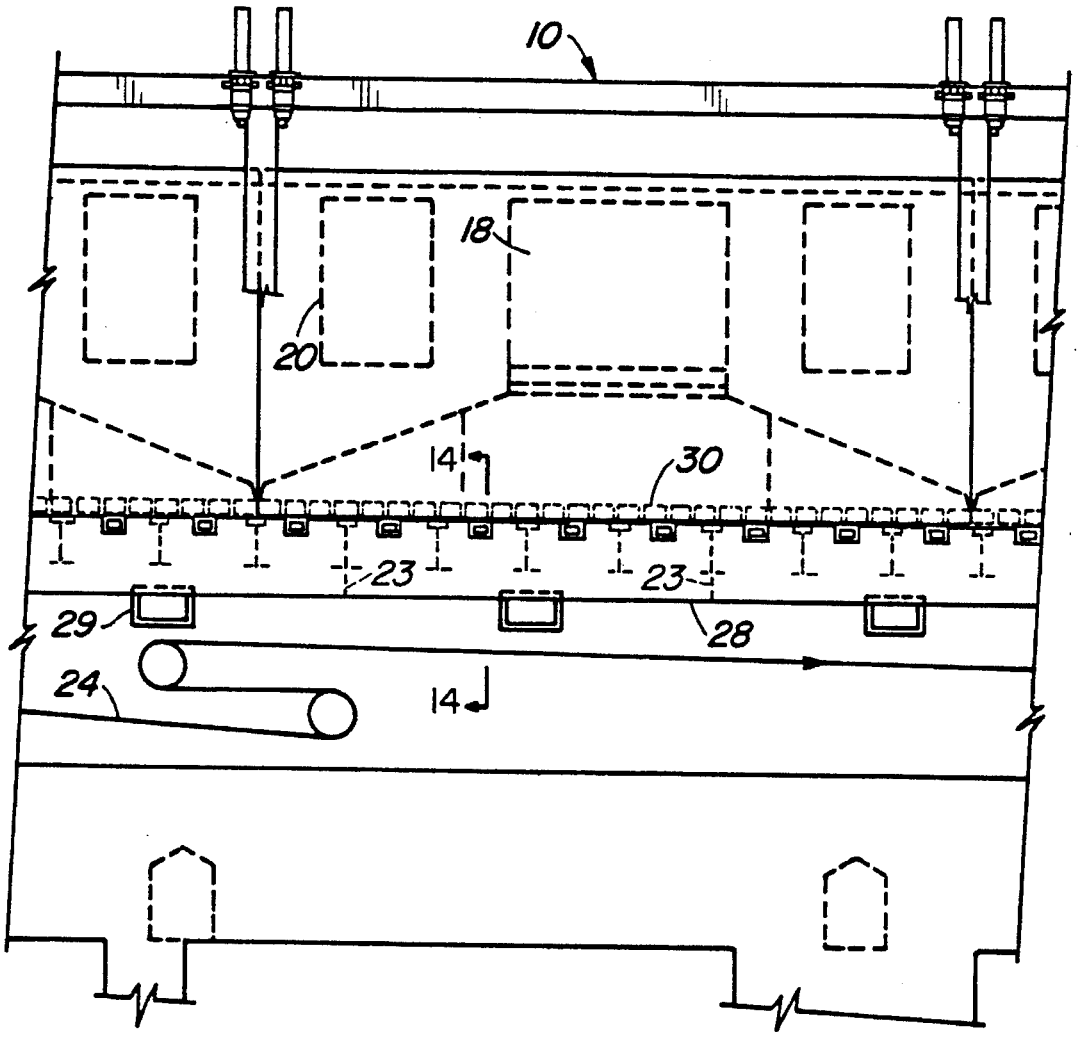
FIG. 10 is a fragmented elevation view of a module, similar to FIG. 5 but showing the use of fabric blades instead of support rolls.

The details of the suction box 28 are illustrated in FIGS. 5 through 9 inclusive. The suction box 28 is divided into individual sections 21 down the length of the box. The number of sections 21 will depend on paper making needs. Each section 21 is sealed, in the case of the rolls 26, to the underside of the roll and, in the case of the fabric blades with lubrication, (FIGS. 10–15) to the bottom of the blades by means of separator sheets 23 that extend vertically downwardly from the roll or the blade to the floor of the box. In a preferred embodiment, there would be a single suction exhaust fan and a header 27 running along the rear side of the suction chamber 28 as shown in FIGS. 6 and 8. A connection 33 is provided for each section 21 and is equipped with a damper 35 as shown in FIGS. 8 and 9 so that the suction could be regulated in each separate section 21 of the box 28. The headers 29 that connect to the suction box 28 would be equipped with openings 37 as shown in FIGS. 8 and 9 designed to provide even suction across the width of the box 28.

FIGS. 7, 8 and 9 illustrate an arrangement utilizing cooling nozzles 52 located on the outer terminal edges of the drying nozzles 30. The cooling nozzles 52 serve two purposes; one is to prevent the spill of hot air out of the dryer and the second is to cool the fabric 24 where there is no paper web. The suction box 28 has side walls 54 with lips or decals 56 on the upper edges thereof, spaced gaps in the lips or decals 56 allowing for the upward protrusion of the portion of the periphery of each of the rolls 26 as illustrated in FIG. 7.

The design of the suction chamber 28 is such that the rolls 26 or fabric blades with lubrication (FIGS. 10–15) are located within the box 28 and, in the case of the rolls, there is a seal 38 where the shaft 39 goes through the side of the box 28. Bearings are on the outside of the box. The edge decals 56 on the suction box 28 are of sufficient width that they extend inside the web width. Air bearing decals are preferable in that they reduce friction to a minimum and also they cool the edges of the fabric 24. Thus, it is important to note that the suction box 28 is sealed such that very little air flow will be required to maintain the suction in the box under the moving fabric 24 and the paper web 11.

Figure 1D:
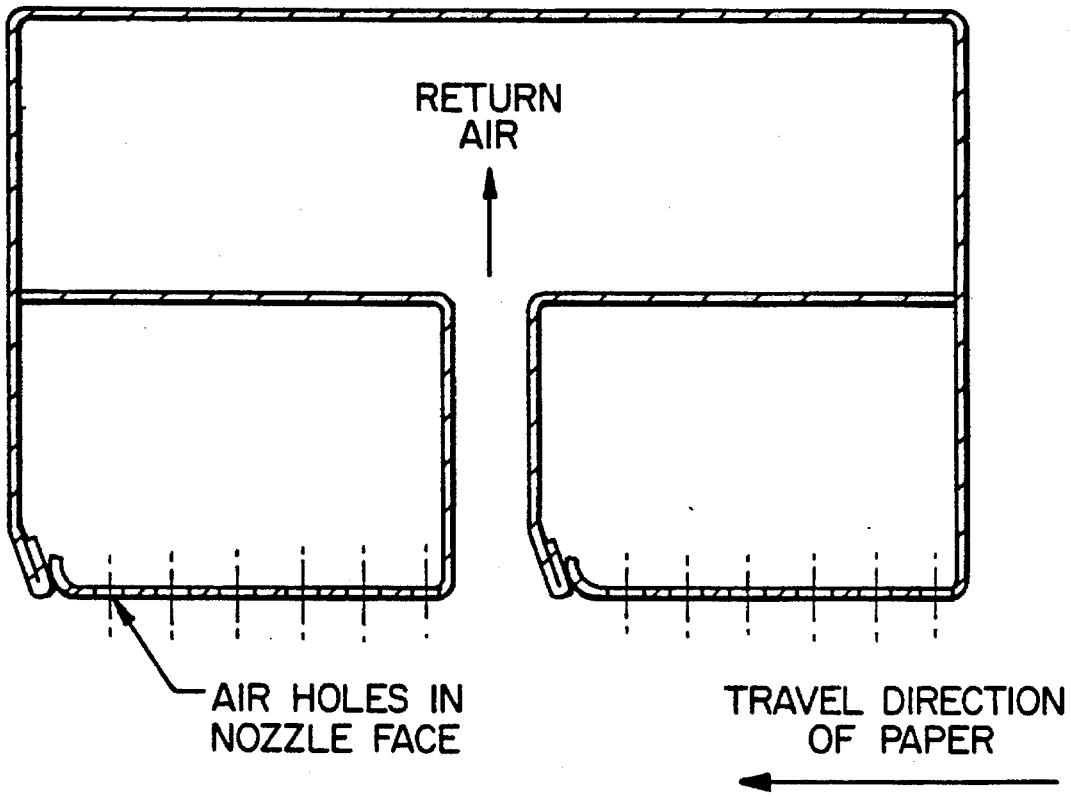
FIG. 1*d* is a cross-section in detail of an end nozzle in the modules in FIGS. 1*a* through 1*c;*
Figure 2:
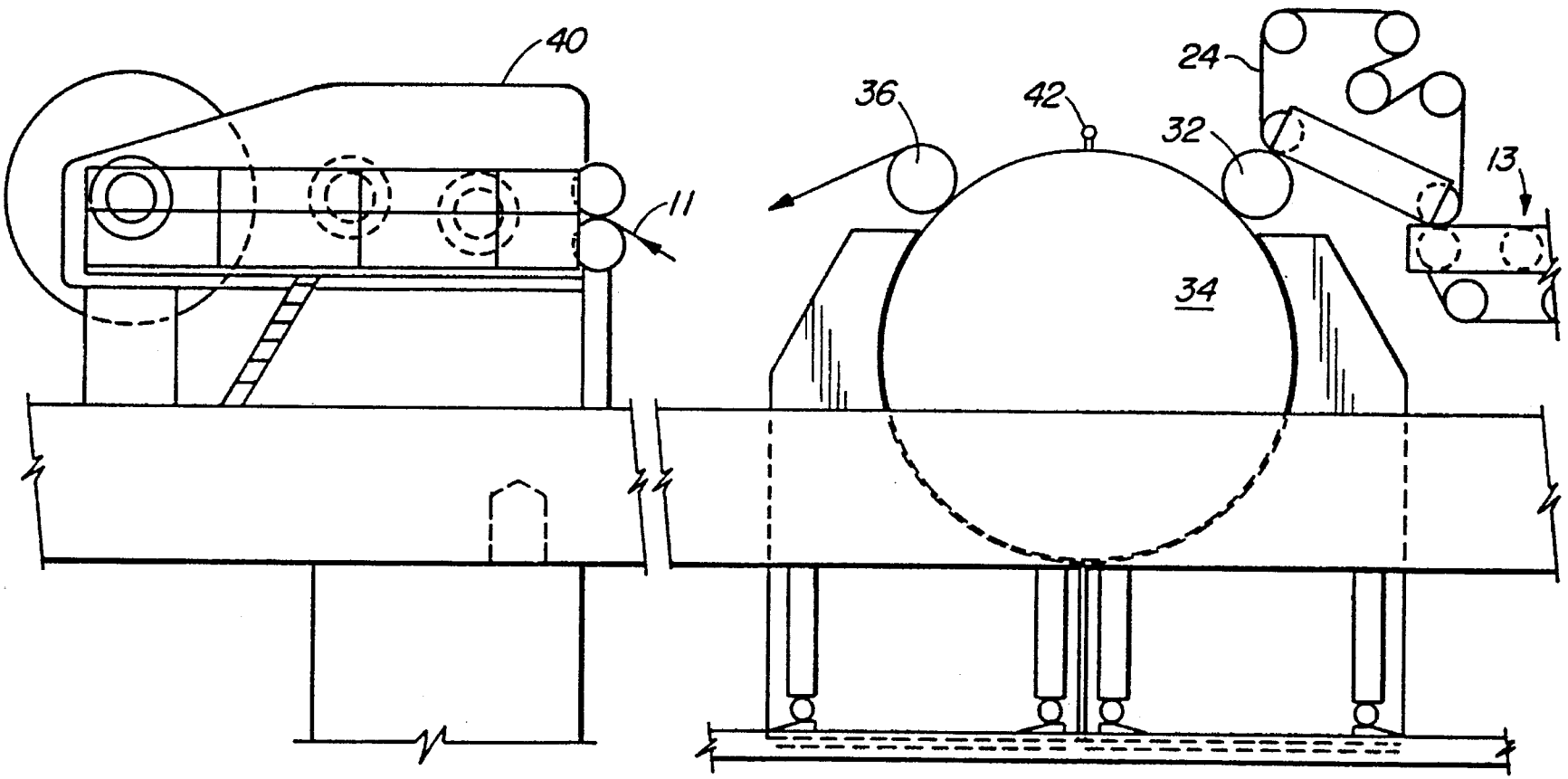
FIG. 2 is a schematic side view of a cylinder and a cylinder air cap located at the takeoff end of the dryer module.

While the illustrated dryer of FIGS. 1*a*–2 shows drying taking place from one side of the web, if it was found that two-sided drying was required then the arrangement could be provided so that either alternate top and bottom drying in each section is provided or, dividing the dryer in two; top and bottom.

In accordance with one embodiment of the invention, the web 11 could be taken off the dry end of the module 10 (left side of FIG. 1*c*) at 93% bd and then to a calender stack, a gloss calender, intercalender dryers and a single soft nip calender 15 and then to a take up reel 40.

Figure 3:
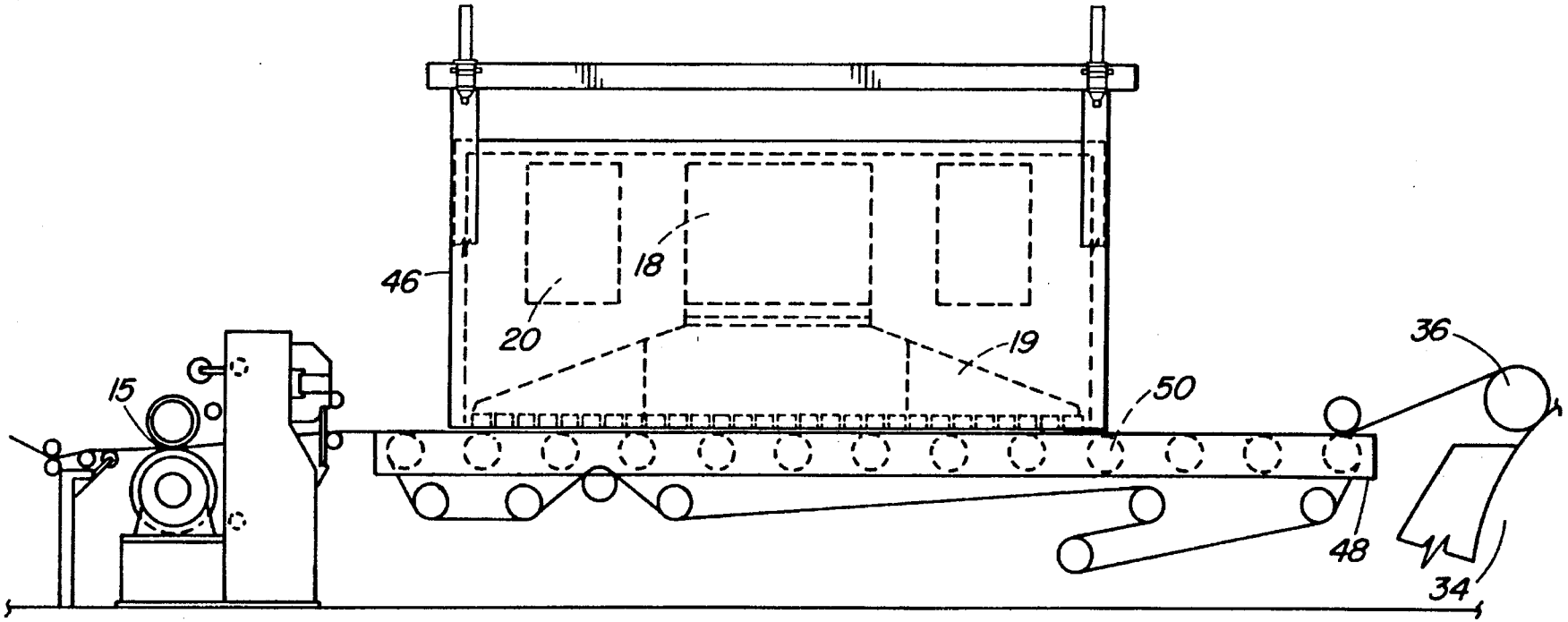
FIG. 3 is a schematic side elevation of a fabric cooling module.

In a preferred arrangement as shown in FIGS. 2 and 3, the web 11 is taken from the dryer module at 75% bd. It is then taken off the restrained-by-suction fabric 24 by a suction roll 32 and the web is then pressed against a polished cylinder 34. After proceeding around the polished cylinder, the web is removed with a further suction roll 36 and is then wound onto a reel 40.

The paper web can be removed from the restrained-by-suction fabric 24 at any moisture level and then be pressed onto the Yankee cylinder by a suction press roll. It can then be removed from the Yankee cylinder by a suction press roll and transferred to the restrained-by-suction fabric 24.

A glue spray 42 is provided in case an application of glue is necessary to obtain sufficient adhesion to the roll to achieve restraint. It is also possible to actually glue the edges of the web 11 to the polished cylinder 34.

As illustrated, a high velocity air cap 44 may be utilized to impinge air at 25,000 fpm and 600° F. to 800° F. on to the web 11 to increase the drying.

By using the polished cylinder dryer a machine glazed finish can be obtained on the web to eliminate the necessity for calendering. While it might not be possible to completely eliminate calendering it is possible to end up with a single, soft nip calender 15 (FIG. 3) instead of the calender stack, gloss calender and intercalender dryer which, together, are extremely expensive.

By imposing a high velocity air cap 44, the outside of the web will be cooled to 180° F. because this is the wet bulb of the 800° F. impinging air. This 180° F. temperature, because of the conductivity of the wet paper web, will pass through to an imposed 211° F. temperature somewhere close in the web to the polished surface of the drying cylinder 34. Thus, vapour generated at the gas heated shell metal/paper interface will only have to move through a very short distance through the web before it is condensed. The web 11 will therefore not lift and a much higher flux may be imposed.

As mentioned earlier, similar benefits could be obtained by using superheated steam at the leaving end of the Yankee cylinder air cap 44. A sufficient portion, such as at 66, of the air cap 44 would be supplied by a separate air system electrically heated so that superheated steam at 700° F. could be used instead of 800° F. air.

Another embodiment of the invention is shown in FIG. 3 in which a paper web cooling module 46 is located between the Yankee type polished dryer 34 and the calender 15 and reel 40. As shown, the cooling module 46 is located over a suction box 48 incorporating support rolls 50. In the second half of the M.G. cylinder air cap 44 the exit temperature of the web would be controlled very accurately to between 230° C. and 250° C. or approximately 482° F. The web would then be quickly cooled with the cooling module 46 down to approximately 100° F. before winding it on the reel 40.

Two nozzle pipes at the wet end and the dry end of both the horizontal air caps and the polished Yankee type cylinder air cap would incorporate blow back nozzles, as shown in FIG. 1*d*, to prevent the entry of room air at the wet end and the spill of hot air or superheated steam at the dry end.

As mentioned earlier in this disclosure, fabric blades with water could be utilized to support the fabric 24 rather than using support rolls 26. One example of an application of this embodiment of the invention is shown in FIGS. 10 through 15 inclusive.

Figure 15:
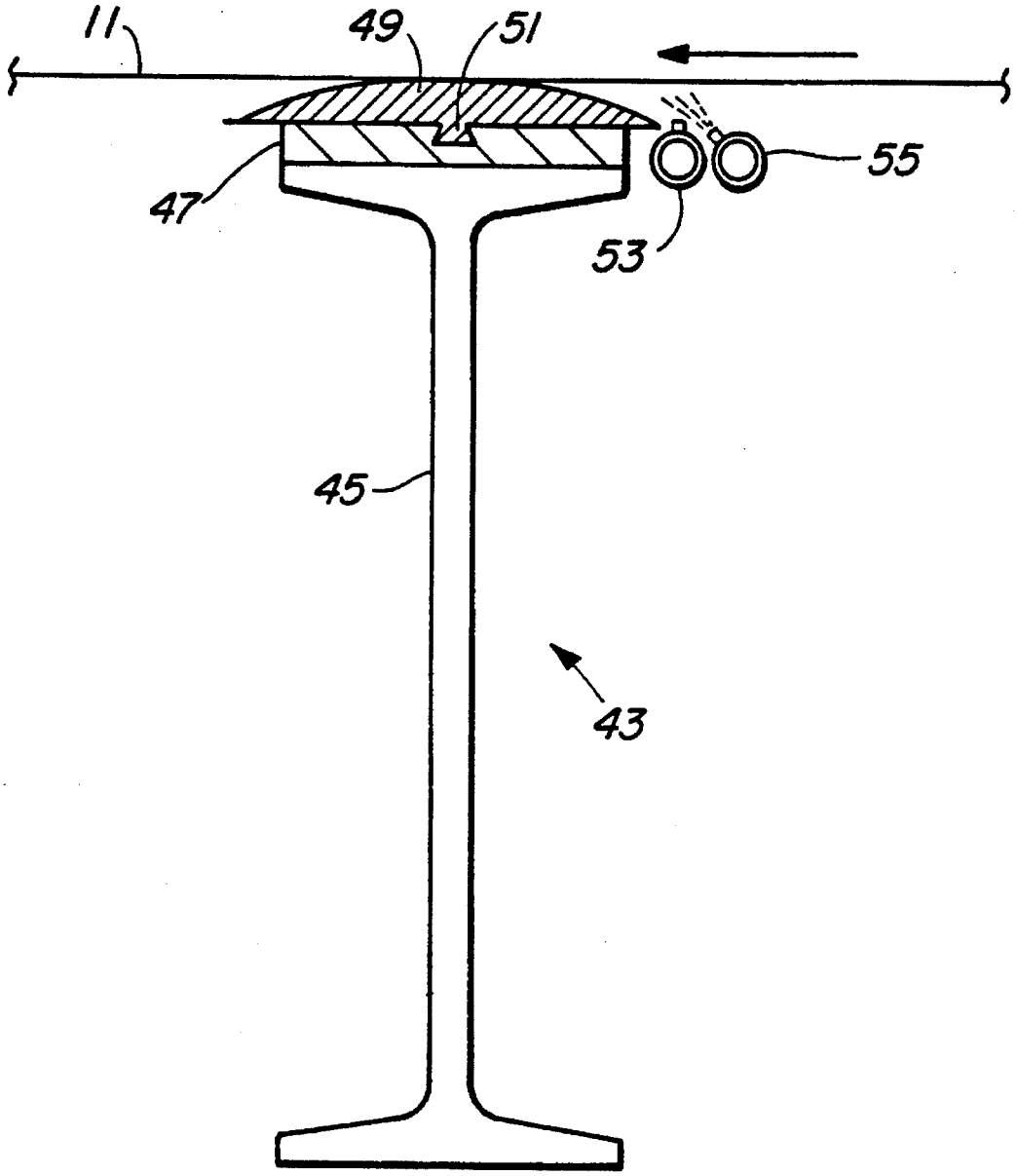
FIG. 15 is a side elevation, partly in section, of a fabric blade.

Looking firstly at FIG. 15, each blade 43 comprises an I-beam 45 approximately 18 inches deep and it is provided with a stainless steel upper surface 47 that includes a cap 49 of zirconium oxide or other suitable material, secured to the stainless steel surface 47 by means, for example, of a dove-tail connection 51 as shown. Air is used from a line 53 to atomize water in a jet thereof from an adjacent water line 55 to provide lubrication.

Turning now to FIGS. 10–14, these figures are comparable to FIGS. 5–9 in which support rolls 26 are used in that the modules 10, nozzles 30, suction box 28 and plenums 29 and 27 are the same or similar.

Figure 12:
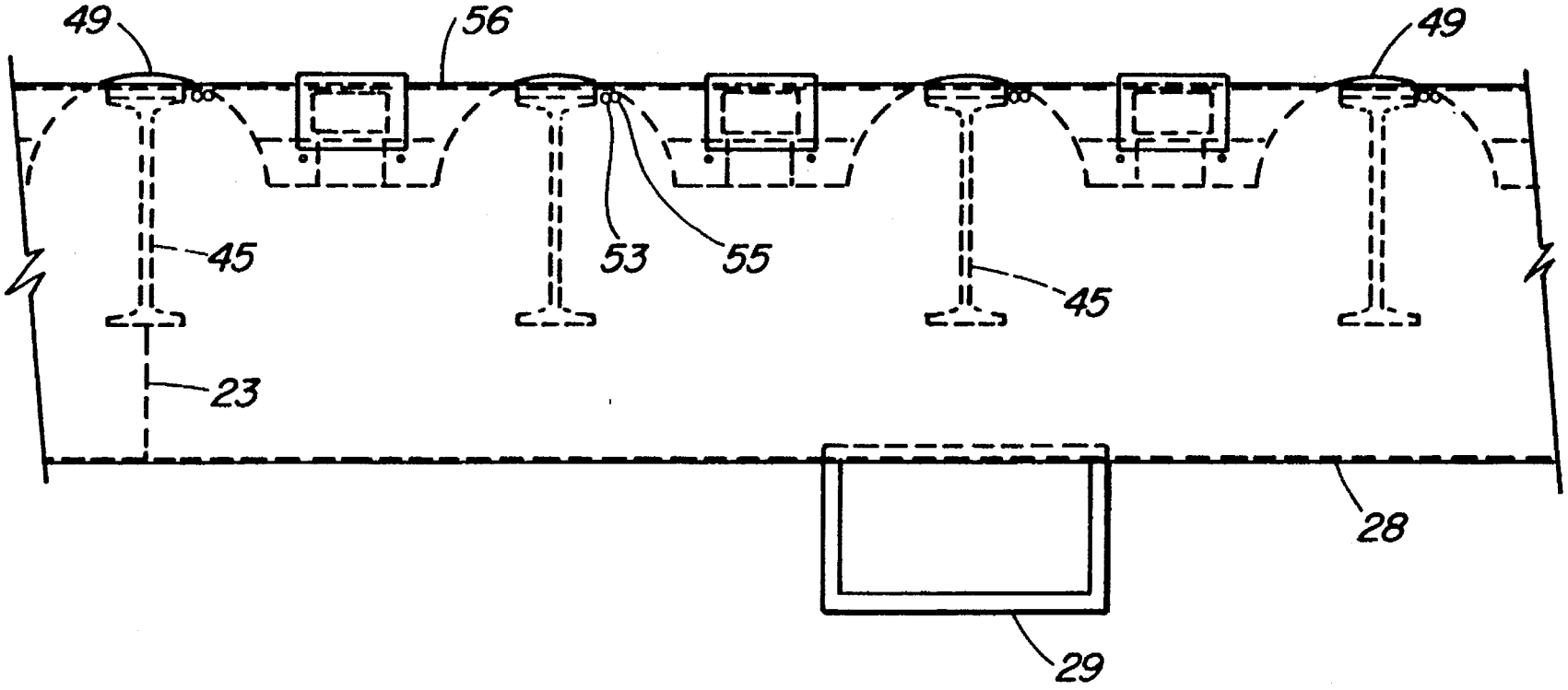
FIG. 12 is a detailed elevation view of a section of FIG. 10.

As shown in FIG. 12, the suction box separator sheets 23 extend downwardly from the lower surface or flange of the blade 45 to the floor of the suction box 28. It will be noted that the caps 49 protrude upwardly slightly through the surface of the suction box 28 and intermediate the decals 56.

Figure 11:
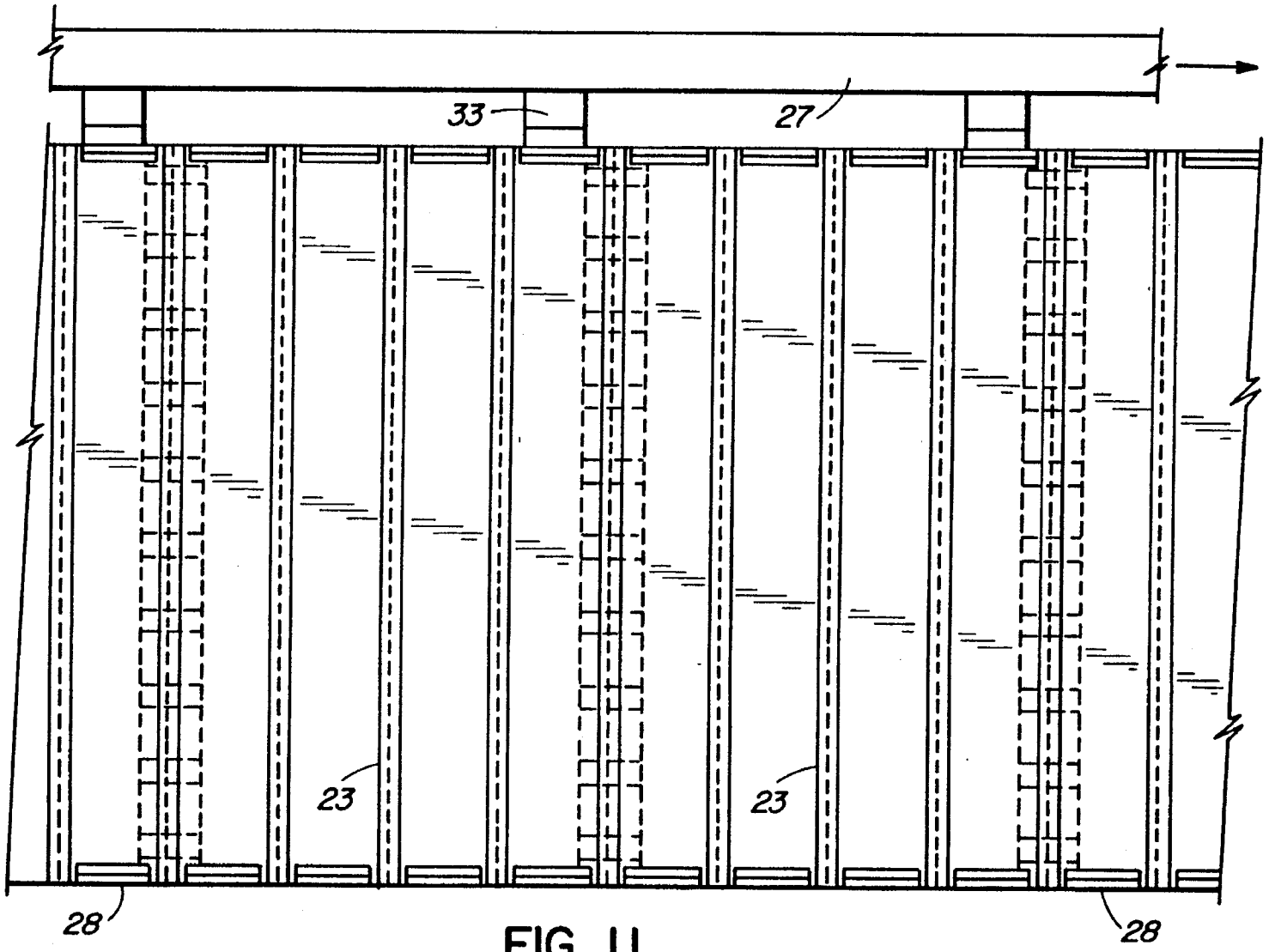
FIG. 11 is a plan view of FIG. 10.
Figure 13:
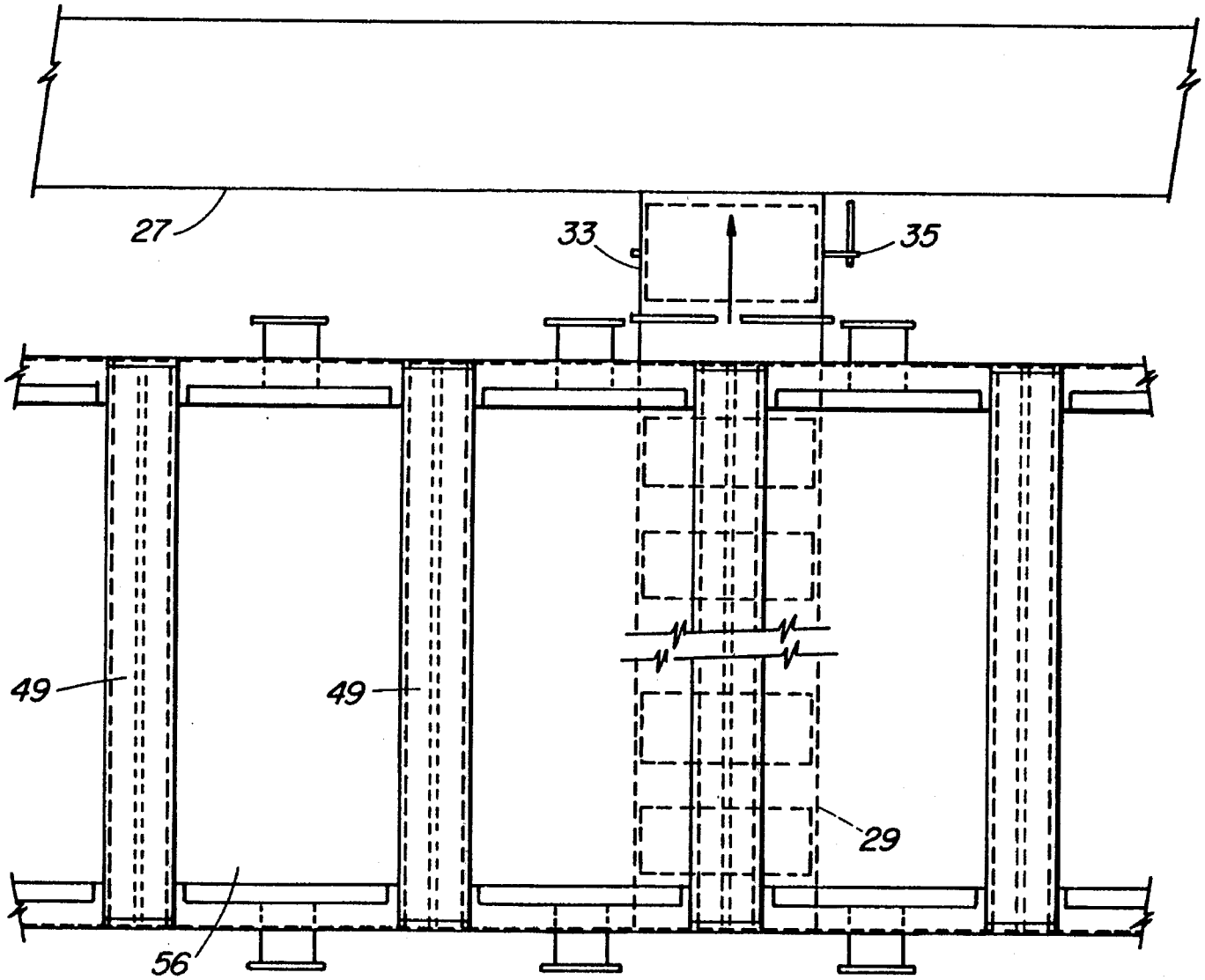
FIG. 13 is a plan view of FIG. 12.
Figure 14:
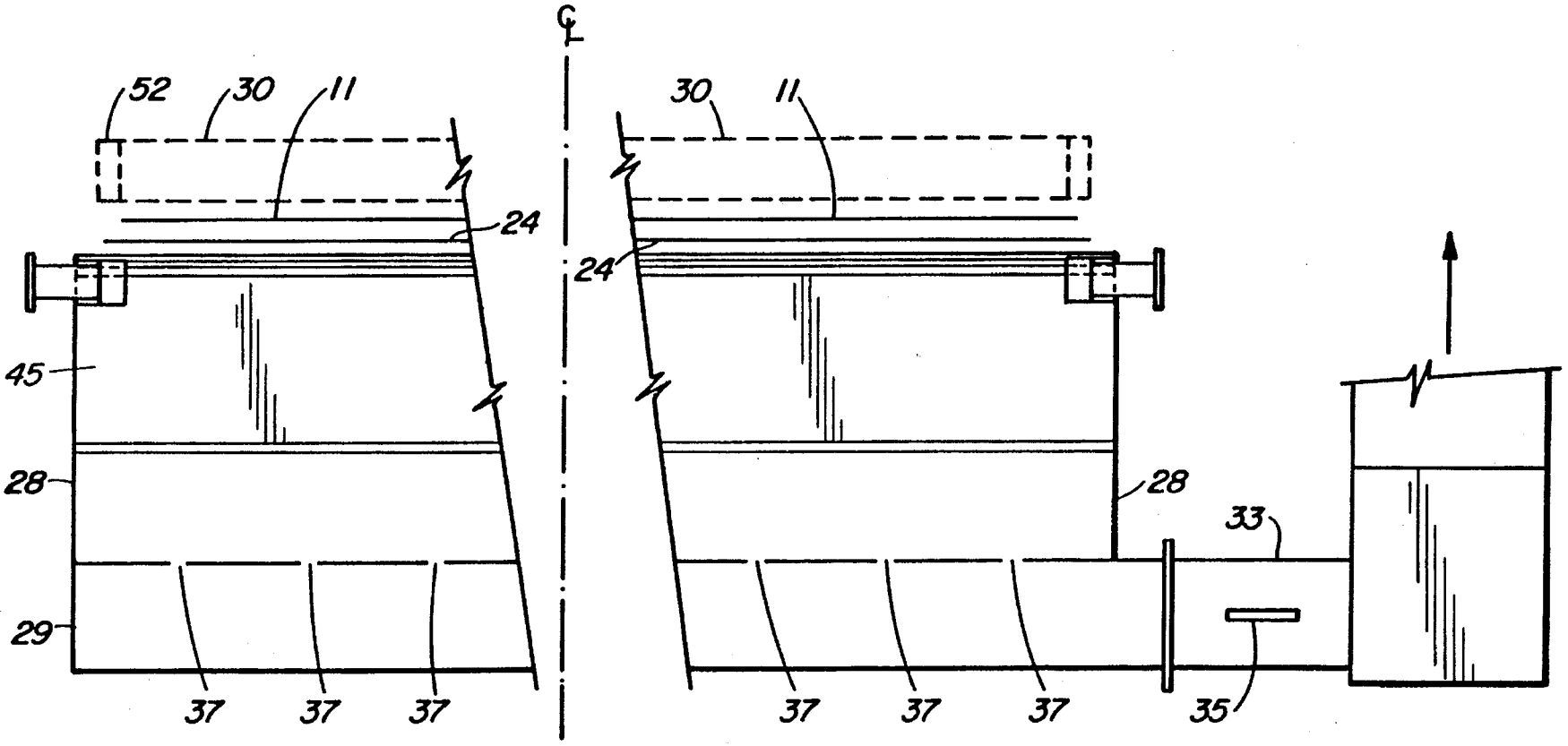
FIG. 14 is a sectional view taken along the line 14—14 of FIG. 10.

As in the embodiment using support rolls 26, the embodiment of FIGS. 10–14 also has the suction box 28 divided along the length of the module and the fabric blades 45 with lubrication by the air line and water lines 53 and 55 respectively are located inside the box 28. The exhaust fan is connected by header 27 which runs along the rear side of the suction chamber 28 as shown in FIGS. 11 and 13. Connections 33 having dampers 35 ensure that the suction could be regulated in each separate section 21 of the box 28.

The other function of the suction chamber 28 is to provide enough suction on the paper web to prevent any wrinkling or movement due to the action of the impinging high velocity air jets. In other words, the suction at the wet end may have to be increased to say 3 inches to prevent wrinkling.

FIGS. 16, 17*a*, 17*b* and 17*c* illustrate a fabric stretch arrangement which could be used in combination with the restrained dryer of the present invention.

In FIG. 16, a restrained dryer module 17 is illustrated with the fabric 24 being circulated over carrier rolls 58 and 60.

A nip roll 62 cooperates with carrier roll 58 and, at the other end, nip roll 64 cooperates with carrier roll 60. Nip roll 64 would be run ½ to 5% faster than nip roll 62 which would result in holding back the fabric at one end and stretching it by ⅕ to 5% by running the other nip roll slightly faster. Concurrently, the support rolls could be replaced by bowed rolls or bowed fabric blades with water as shown in FIGS. 17*a*, 17*b* and 17*c*. The return run rolls or fabric blades with water would have the reverse bow to present a concave surface to the fabric. FIG. 17*a* shows the use of a bowed roll at location A in FIG. 16 while FIG. 17*b* shows the bowed roll at location B in FIG. 16.

The return run of the fabric 24 at location C in FIG. 16 is shown in FIG. 17*c*. By having the return run roll or fabric blades with water with the reverse bow would tend to remove the ⅕ to 5% width stretch which had been introduced in the fabric. To aid in this shrinkage and also to shrink the fabric back to its original length, water would be added and then the fabric would be dried to bring it back to its original dimensions.

A ½% to 5% stretch of the web in the two dimensions would give significant benefits and the method to achieve this is shown in FIG. 16. The bowed rolls or bowed fabric blades with water would cause the fabric to stretch ½% to 5% in the width dimension. Sufficient suction would be imposed to hold the fabric against the bowed rolls or bowed fabric blades with water so that stretching could occur.

Figure 18:
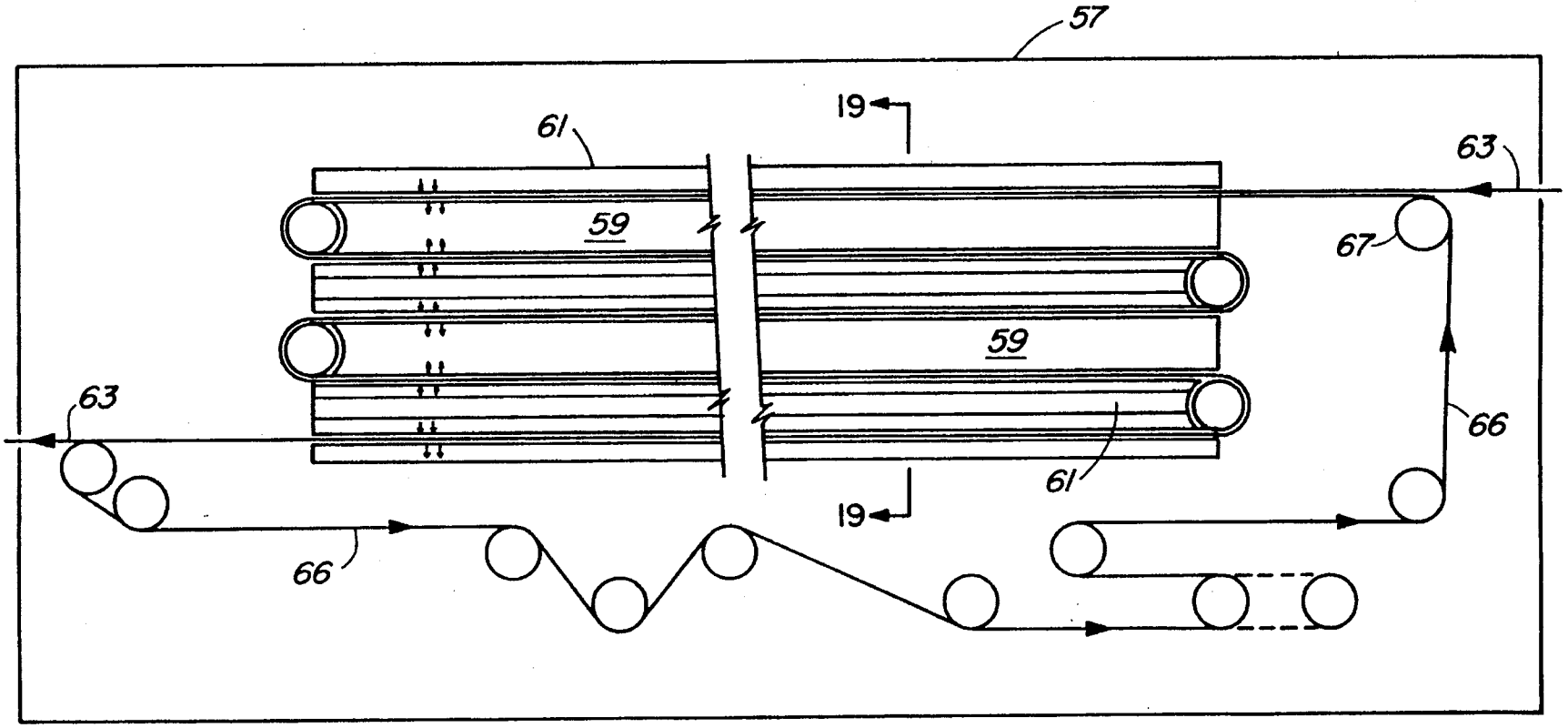
FIG. 18 is a schematic elevation view of a pulp dryer alternative for the methods and apparatus according to the invention.
Figure 19:
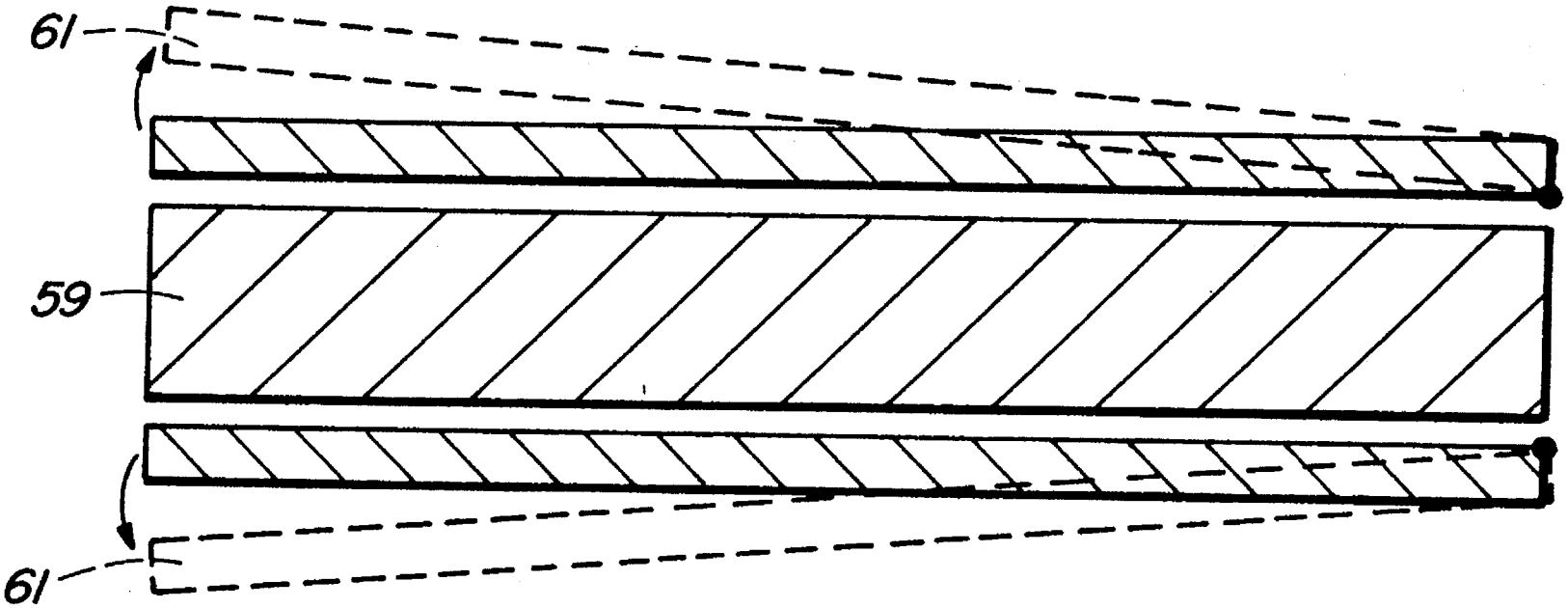
FIG. 19 is a sectional view taken along the lines 19—19 of FIG. 18.

FIGS. 18 and 19 shows an alternative type dryer alternative for the restrained dryer concept of this invention.

A housing 57 encloses a plurality of suction boxes 59 arranged in a stack intermediate jet impingement blow boxes 61. A paper web 63 enters the housing 57 and, by means of a fabric 66 and various support and guide rollers 67, the web 63 is passed between the jet impingement blow box 61 and the suction boxes 59 and to make a plurality of passes back and forth before being removed from the opposite end of the housing as shown at the left side of FIG. 18.

The air suction and impingement system of the earlier described embodiment would be suitably modified to accommodate this arrangement.

FIG. 19 serves to illustrate the system of hinging the blow boxes in order to remove broke.

It will be appreciated that the main benefit from the invention will be obtained from drying a web from 55% bd to 93% bd. Additional benefits can be obtained by drying, for example, from the last press at normally 40% bd. The use of superheated steam and stretching could also be incorporated. A dryer according to the invention could easily replace the complete dryer section of a linerboard machine.

While the invention has been described in connection with a specific embodiment thereof and in a specific use, various modifications thereof will occur to those skilled in the art without departing from the spirit and scope of the invention as set forth in the appended claims.

The terms and expressions which have been employed in this specification are used as terms of description and not of limitations, and there is no intention in the use of such terms and expressions to exclude any equivalents of the features shown and described or portions thereof, but it is recognized that various modifications are possible within the scope of the invention claims.

I claim:

1. An improved method of drying a moving paper web in an elongated drying apparatus comprising the steps of:

a) holding the web in a restrained position on an open weave fabric by means of air suction from 3 to 12 inches $H_2O$ imposed progressively along the length of the drying apparatus from underneath the web and sufficient to prevent shrinkage of the web; and b) applying a drying medium to said web in the form of high temperature, high velocity air or superheated steam, whereby shrinkage of said web is substantially inhibited, ring crush strength is increased and fibre requirements are reduced.

2. A method according to claim 1 wherein the high velocity, high temperature air or superheated steam is applied to the web at approximately 25,000 fpm and 600° to 800° F.

3. A method according to claim 1 wherein the paper web enters the restrained drying apparatus at approximately 55% dry and is removed from the restrained drying apparatus at 75% or 93% dry.

4. Apparatus for drying and moving paper web comprising:

an elongated module having a plurality of drying nozzles spaced throughout the length of said module;

a suction box arranged opposite said module and the drying nozzles therein and defining a path of travel for said paper web between said nozzles and the suction box;

means in said suction box for providing support for a fabric, web-supporting belt;

means for delivering high velocity, high temperature air or superheated steam to said nozzles for impingement against at least one surface of said web; and means for simultaneously applying suction from 3 to 12 inches $H_2O$, progressively throughout the length of said suction box, to the other surface of said web sufficient to prevent shrinkage thereof during drying.

5. Apparatus according to claim 4 wherein said module includes present headers to distribute said drying medium to said nozzle;

means for providing a source for said drying medium; and duct means for transmitting said medium to said module and the headers therein;

said nozzles being segmented to control the drying process.

6. Apparatus according to claim 5 wherein said drying medium is high velocity, high temperature air or superheated steam applied by said nozzles against the web at approximately 25,000 fpm and 600° to 800° F.

7. Apparatus according to claim 4 wherein said fabric support means in said suction box comprises a plurality of rollers spaced along the length of said suction box.

8. Apparatus according to claim 4 wherein said fabric support means in the suction box comprises a plurality of fabric blades with water spaced throughout the length of said suction box.

9. An improved method of drying a moving paper web in an elongated multi-pass drying apparatus comprising the steps of:

a) holding the web in a restrained position on an open weave fabric by means of air suction from 3 to 12 inches $H_2O$ imposed progressively along the length of each pass of the multi-pass drying apparatus from underneath the web and sufficient to prevent shrinkage of the web; and b) applying a drying medium to said web along each pass of the multi-pass apparatus in the form of high temperature, high velocity air or superheated steam, whereby shrinkage of said web is substantially inhibited, ring crush strength is increased and fibre requirements are reduced.

10. A method according to claim 9 wherein the high velocity, high temperature air or superheated steam is applied to the web at approximately 25,000 fpm and 600° to 800° F.

11. A method according to claim 9 wherein the paper web enters the multi-pass restrained drying apparatus at approximately 55% dry and is removed from the restrained drying apparatus at 75% or 93% dry.

12. Apparatus for drying a moving paper web comprising:

a housing enclosing a plurality of jet impingement blow boxes arranged in a stack and each having a plurality of drying nozzles spaced throughout the length of the box;

a plurality of suction boxes arranged in the stack intermediate said jet impingement blow boxes; said blow boxes and suction boxes defining between them a path of travel for said paper web;

means in said suction boxes for providing support for a fabric, web-supporting belt;

suction turning and guide rolls at each end of said suction boxes for turning and guiding said fabric and web;

means for delivering high velocity, high temperature air or superheated steam to said nozzles for impingement against at least one surface of said web on each pass of the apparatus; and means for simultaneously applying suction from 3 to 12 inches $H_2O$, progressively throughout the length of said suction boxes, to the other surface of said web sufficient to prevent shrinkage thereof during drying.

13. Apparatus according to claim 12 wherein said drying medium is high velocity, high temperature air or superheated steam applied by said nozzles against the web at approximately 25,000 fpm and 600° to 800° F.

14. Apparatus according to claim 12 wherein said jet impingement blow boxes are hingedly mounted in said housing so as to provide servicing access to the paths of travel of said web.

* * * * *